United States Patent [19]

Del Gatto et al.

[11] Patent Number: 4,928,456

[45] Date of Patent: May 29, 1990

[54] PROCESS FOR RAPPING OF ELECTROSTATIC PRECIPITATOR SURFACES

[75] Inventors: Henry J. Del Gatto, New Egypt; John E. Trainor, Willingboro, both of N.J.

[73] Assignee: NWL Transformers, Bordentown, N.J.

[21] Appl. No.: 207,778

[22] Filed: Jun. 16, 1988

[51] Int. Cl.[5] ..... B03C 3/76

[52] U.S. Cl. ..... 55/12; 55/112; 364/502; 377/43

[58] Field of Search ..... 364/502; 323/903; 55/12, 112; 377/43

[56] References Cited

U.S. PATENT DOCUMENTS

| | | | |
|---|---|---|---|
| 3,487,606 | 1/1970 | Bridges | 55/13 |
| 3,504,480 | 4/1970 | Copcutt et al. | 55/112 |
| 3,754,379 | 8/1973 | Bridges | 55/112 |
| 4,008,057 | 2/1977 | Gelfand et al. | 55/112 |
| 4,285,024 | 8/1981 | Andrews | 55/112 |
| 4,432,062 | 2/1984 | Herklotz et al. | 55/112 |

*Primary Examiner*—Bernard Nozick
*Attorney, Agent, or Firm*—Ratner & Prestia

[57] ABSTRACT

A method for removing precipitate from a collecting surface of an electrostatic precipitator by rapping a point on the surface. Mechanical energy is applied a plurality of times with a rapper wherein the level of mechanical energy increases from one application of energy to another. Thus precipitate is removed from regions of the collecting surface progressively more distant from the energy application point. The time period between applications is selected to cause removal of precipitate from a region of the surface to be coincident with falling precipitate from regions above. The level of mechanical energy is controlled by applying to the rapper a sequence of full half-cycles of electrical energy followed by a single phase conduction cycle. The applied current is sensed and the duration of current application is adjusted to provide a predetermined energy level to the rapper. The polarity of the current is reversed to prevent magnetization of the rapper.

8 Claims, 9 Drawing Sheets

Microfiche Appendix Included
(10 Microfiche, 616 Pages)

PROCESS FOR RAPPING OF ELECTROSTATIC PRECIPITATOR SURFACES

A Microfiche Appendix is included and in this application containing 10 microfiche. Each microfiche numbered 1 to 9, contains 62 frames plus one test target frame, for a total of 63 frames per microfiche. The last microfiche, numbered 10, contains 48 frames plus one test target frame for a total of 49 frames.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all rights whatsoever.

A. Field of the Invention

This invention relates to removal of precipitate from a collecting surface of an electrostatic precipitator.

B. Background of the Invention

Dispersion Problems

Collecting surfaces of electrostatic precipitators must be periodically cleaned of collected precipitate. It is known to clean such surfaces using electromechanical devices to cause vibration and oscillation of the surfaces. These electromechanical devices included impact hammers or rappers as well as electromechanical vibrators. In electrostatic precipitators the amount of mechanical energy applied by the rappers was controlled by varying the number of full half cycles or the number of diminished conduction angle half cycles of an alternating or rectified source applied to the rapper. The amount of mechanical energy applied by the vibrators was controlled by varying the electrical power (conduction angle) applied and the duration of excitation.

In the past, either a single rap of applied mechanical energy or a plurality of raps of mechanical energy were used for each cleaning cycle. The amount of energy of the single rap on the plurality of raps was constant and was usually chosen in an attempt to dislodge all of the surface precipitate from a collecting surface. However, if excessive energy were applied, the precipitate could be sufficiently disturbed that the collected mass of the precipitate was dispersed into small particles that lacked sufficient mass density to cause them to fall free of the electrostatic precipitator. The small dispersed particles were then carried with the gas flow and were either reentrained within the electrostatic precipitator or expelled through the exhaust stack. Reentrainment of dispersed particles resulted in decreased efficiency of the electrostatic precipitator, decreased efficiency of rapper energy use and decreased control of particulate emissions.

The amount of mechanical energy received by an incremental area of the precipitate layer of a collecting surface is inversely related to the distance of the area from the point of the collecting surface where the energy is applied. Therefore precipitate areas close to the area of energy application vibrate more than areas farther from the energy application. Thus sufficient mechanical energy when applied to dislodge precipitate from more remote areas resulted in dispersion of precipitate from areas near the energy source causing possible reentrainment. If the level of applied mechanical energy was selected low enough to prevent dispersion of precipitate near the energy source, precipitate in more remote areas may not be removed.

Magnetization Problems

Magnetic energy is used to lift the rods of gravity return rappers when removing precipitate from the collecting surface of an electrostatic precipitator. The application of this magnetic energy to the rapper rods causes residual magnetism in the rappers. This residual magnetism diminished rapper lift for later energization cycles and eventually caused the rod to adhere to the striking anvil on the collecting surface. Magnetization of the rapper is minimized by applying power for the shortest possible time. Systems that applied full conduction half-cycle pulses for a single rap minimized this application time, but did not allow precise control of rod lift. Systems that applied reduced conduction angle half-cycle pulses allowed precise control of lift, but caused excessive magnetization of the rapper because of the extended energization time.

Whether the system applied full conduction half-cycle pulses or reduced conduction angle half-cycle pulses, all the pulses were of the same polarity causing additive magnetization of the rapper rod. As the rappers were repeatedly energized with current in the same direction, the coil assembly as well as the rapper casing developed residual magnetization. This magnetization caused the rapper rod to adhere to the striker anvil on the collecting surface and caused significant reduction in the amount of rapper lift. In applications requiring low lift, the rapper rod became sufficiently magnetized that the rapper rod failed to lift off of the anvil. A known solution to this problem has been to add striker plates of less magnetic material between the rapper rod and the anvil. While this helped to prevent rods sticking to anvils, it did not solve the basic problem of increasing magnetization of the rods and casings.

The application of energy to the rapper coil has been adjusted by varying the number of cycles applied or by varying the conduction phase angle, to provide the desired rod lift. The amount of lift for a given rapper in response to a selected number of applied cycles or a selected conduction angle has then been determined by the line resistance of the connecting cables of the precipitator system, by the temperature of the rapper, and the magnitude of the incoming line power. It has been known to monitor the voltage at the rapper. However, as these parameters changed, causing variations in lift, the changes in parameters could not be compensated on the basis of rapper voltage.

SUMMARY OF THE INVENTION

A method for removing precipitate from the collecting surface of an electrostatic precipitator wherein mechanical energy is applied to the collecting surface to cause the collecting surface to vibrate. Mechanical energy is applied a plurality of times while the level of mechanical energy applied increases from one application to another application. The level of mechanical energy is controlled by applying to the rapper a sequence of full half cycles of electrical energy followed by a single phase conduction cycle.

DETAILED DESCRIPTION OF THE INVENTION

Figure 1:
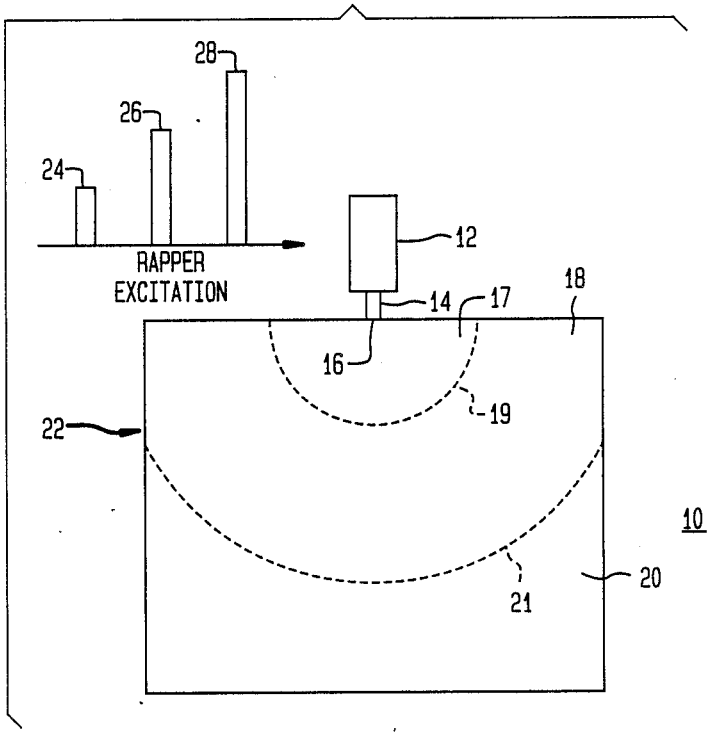
FIG. 1 shows the precipitate removal system of the present invention.

Referring now to FIG. 1, there is shown a portion of electrostatic precipitator system 10 for removal of particulate matter from the environment. In system 10, precipitate (not shown) adheres to collecting surface or electrode 22. Impulse rapper 12 having hammer rod 14 applies mechanical energy to collecting surface 22 at mechanical energy application point 16 of collecting surface 22 to remove precipitate by rapping rod 14 against surface 22 at point 16. When mechanical energy is applied to collecting surface 22 by rapper 12, collecting surface 22 vibrates causing precipitate adhered to collecting surface 22 to be removed and to fall free.

To cause hammer rod 14 to apply mechanical energy to surface 22, electrical excitation is applied to rapper 12. The level of electrical excitation energy applied to rapper 12 determines how hard rod 14 of rapper 12 strikes collecting surface 22 and thereby determines how much mechanical energy is applied to collecting surface 22 and how much collecting surface 22 is caused to vibrate.

The vibration due to rod 14 striking surface 16 radiates substantially radially from application point 16 where rod 16 strikes collecting surface 22 and falls off rapidly as the radial distance from point 16 increases. Thus, for example, a relatively small amount of rapper excitation may be required to clear precipitate from region 17 of collecting surface 22 where region 17 is close to application point 16 and generally bounded by dotted line 19. An amount of rapper excitation greater than the excitation required to remove precipitate from region 17 is required to remove precipitate from region 18 where region 18 is generally bounded by dotted lines 19,21. A still greater amount of rapper excitation is required to remove precipitate from region 20 of collecting surface 22 where region 20 is the region on the side of dotted line 21 farthest from point 16.

If sufficient energy is applied to collecting surface 22 to cause precipitate within region 20 to fall from collecting surface 22, then precipitate in region 17 may be disturbed with enough energy that it is dispersed into small particles that lack sufficient mass density to cause them to fall free of collecting surface 22. As previously described, such particles may be reentrained in precipitator system 10 decreasing the efficiency of the system 10 or they may be expelled to the environment. Conversely, an amount of energy small enough to prevent dispersion of precipitate in region 17 may not be sufficient to remove precipitate from region 20.

Thus, within system 10 increasingly higher levels of electrical excitation energy are applied to rapper 12 to provide a plurality of impacts of rod 14 against point 16 wherein the impacts apply increasingly higher levels of mechanical energy to collecting surface 22. For example, rapper excitation pulses 24,26,28 may be applied to rapper 12 where pulse 26 has a higher level of electrical excitation energy than pulse 24 and pulse 28 has a higher level of electrical excitation energy than pulse 26.

More specifically, relatively small rapper excitation pulse 24 may be applied to rapper 12 to cause rod 14 to apply a relatively small level of mechanical energy to collecting surface 22. This small level of mechanical energy is selected to be sufficient to remove precipitate from region 17 but not necessarily sufficient to remove precipitate from regions 18,20 of collecting surface 22. Thereafter, larger rapper excitation pulse 26 may be applied to rapper 12 to cause rod 14 to again strike collecting surface 22 and to apply a higher level of mechanical energy than was applied as a result of pulse 24. The larger amount of mechanical energy applied as a result of pulse 26 is selected to cause precipitate adhered to collecting surface 22 in region 18 to fall from collecting surface 22. This larger amount of excitation energy does not cause dispersion of precipitate from region 17 because precipitate has already been removed from region 17 by the mechanical energy applied as a result of pulse 24.

Finally, the highest level of rapper excitation, pulse 28, is applied to rapper 12. Pulse 26 causes rod 14 of rapper 12 to apply enough mechanical energy to collecting surface 22 to cause precipitate to fall from region 20 of collecting surface 22. The vibration caused in response to pulse 28 may be large enough to cause dispersion of the precipitate which was on regions 17,18 if this precipitate had not been removed. However, since the precipitate of regions 17,18 was removed by pulses 24,26, respectively, this dispersion problem is eliminated. Thus a plurality of applications of mechanical energy is provided wherein the level of mechanical energy increases from one application to the next in order to clean increasingly distant regions of collecting surface 22 without causing dispersion of precipitate on regions close to application point 16.

Figure 2:
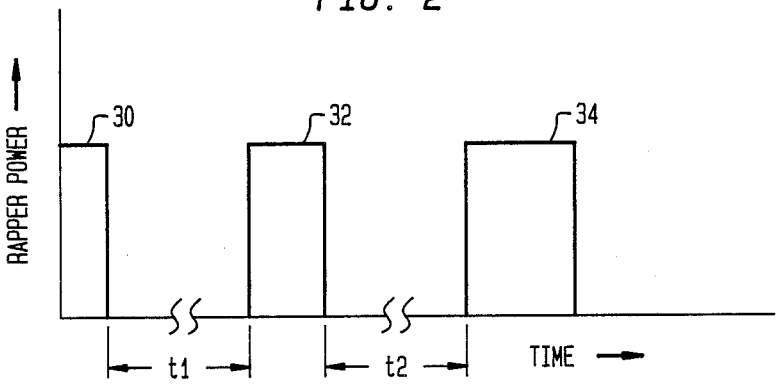
FIG. 2 shows power waveforms of increasing duration for controlling excitation of the rapper of FIG. 1.

Referring now to FIG. 2, there is shown a graphical representation of rapper power applied to impulse rapper 12 within system 10. Rapper power waveforms 30,32,34 provide rapper exitation energy pulses 24,26,28 respectively. It will be understood by those skilled in the art that the levels of rapper excitation energy of pulses 24,26,28 are controlled by the duration of applied power waveforms 30,32,34. If power is applied to rapper 12 for a longer period of time a higher level of energy is provided and rod 14 will have more lift and will fall harder on collecting surface 22 at the end of the power waveform.

To provide a relatively low level rapper excitation energy pulse 24 to impulse rapper 12 relatively short power waveform 30 is provided. To provide relatively larger rapper exitation energy pulse 26, power waveform 32 of a relatively longer time duration is provided. To provide relatively larger rapper excitation energy pulse 26, power waveform 32 of a relatively longer time duration is provided To provide high rapper excitation energy waveform 28, power waveform 34 of a still longer duration is provided.

The time duration of power waveforms 30,32,34 are in the range of about 0.05 seconds to about 0.10 seconds depending on the selected lift. Time periods $t_1$ and $t_2$ between power waveforms 30,32,34 must be sufficient to allow rapper rod 14 to complete its normal rise/fall cycle. These time periods may be between approximately 0.20 seconds and approximately 0.60 seconds. The time cycle of rapper 12 is the sum of the time for rod 14 to complete its up and down motion and includes the upward acceleration of rod 14 during excitation.

In our embodiment, the time interval between consecutive raps of collecting surface 20 by rapper 12 may be adjusted such that the second and third raps occur concurrently with falling precipitate from collecting surface 20. For example, a first rap may dislodge precipitate from region 17 of collecting surface 22, causing the dislodged precipitate to fall downward in the direction of region 18. The second rap of rapper 12 may be timed such that the vibrations of the second rap which dislodge precipitate from region 18 reach region 18 at the same time that the dislodged falling precipitate from region 17 reaches region 18. Thus the falling precipitate from region 17 hits the precipitate in region 18 at the same time that the vibrations of the second rap hits region 18, thereby assisting in the removal of precipitate from region 18.

Likewise the vibrations of collecting surface 22 for dislodging precipitate from region 20 caused by the third rap may be coincident with precipitate from regions 17,18. The coincident vibration of region 20 and force against the precipitate on region 20 from precipitate above region 20 aid in the removal of precipitate from region 20.

The calculation of the time interval between raps required to achieve this free fall aiding mechanism is based upon the length of collecting surface 22 from top to bottom and the number of consecutive raps selected. This time may be approximated by the equation:

$$T = \frac{2L}{NA},$$

where L is the length of collecting surface 22 from top to bottom, N is the number of raps selected by an operator using computer 68 (FIG. 4), and A is the acceleration due to gravity. When this free fall aiding mechanism is not used, time durations $t_1$ and $t_2$ may be greater.

Figure 3:
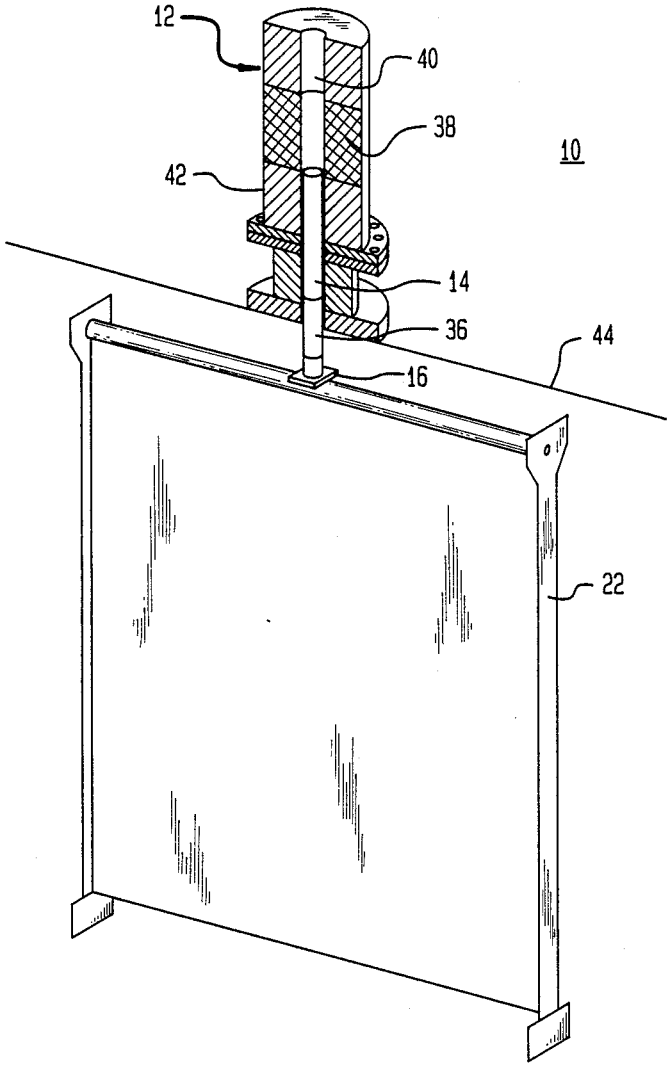
FIG. 3 shows a more detailed representation of the system of FIG. 1.

Referring now to FIG. 3, there is shown a cross-sectional view of the single rapper 12 within system 10 attached to roof line 44 of precipitator system 10 above the top of collecting surface 22. It will be understood that two or more rappers 12 may be provided in system 10 and that if a plurality of rappers 12 is provided they may be distributed across the top of collecting surface 22. It will also be understood that if more than one rapper 12 is attached to collecting surface 22 as shown a first rapper 12 may receive a first rapper excitation pulse, for example pulse 24, and provide a first application of mechanical energy to collecting surface 22, while a different rapper 12 (not shown) may receive one or more of the remaining rapper excitation pulses, for example pulse 26 or pulse 28. The first rapper 12 or any other rapper 12 may receive a third excitation pulse. Thus any number of rappers 12 may be used in accordance with the present invention provided the levels of mechanical energy applied to the collecting surface increases from one application to another.

Steel anvil 36 couples the mechanical energy of falling hammer rod 14 to collecting electrode 22. When electrical power is applied to rapper coil 38 within rapper casing 42, rapper coil 38 provides a magnetic field which causes rapper rod 14 to lift upwardly away from rapper anvil 36 and into tubular region 40 above rapper rod 14. The amount of lift above rapper anvil 36 that is imparted to rod 14 is controlled by the level of rapper excitation energy applied to coil 38 of rapper 12 as previously described. The distance of rapper lift may be in the range of about one-half inch to fourteen inches. Rapper rod 14 typically has a weight in the range of about eight pounds to twenty pounds. Thus the total mechanical energy imparted by rod 14 to collecting surface 22 by way of anvil 36 may vary from one third foot pound to eight foot pounds for eight pound rappers 12 and up to twenty three foot pounds for twenty pound rappers 12.

Figure 4:
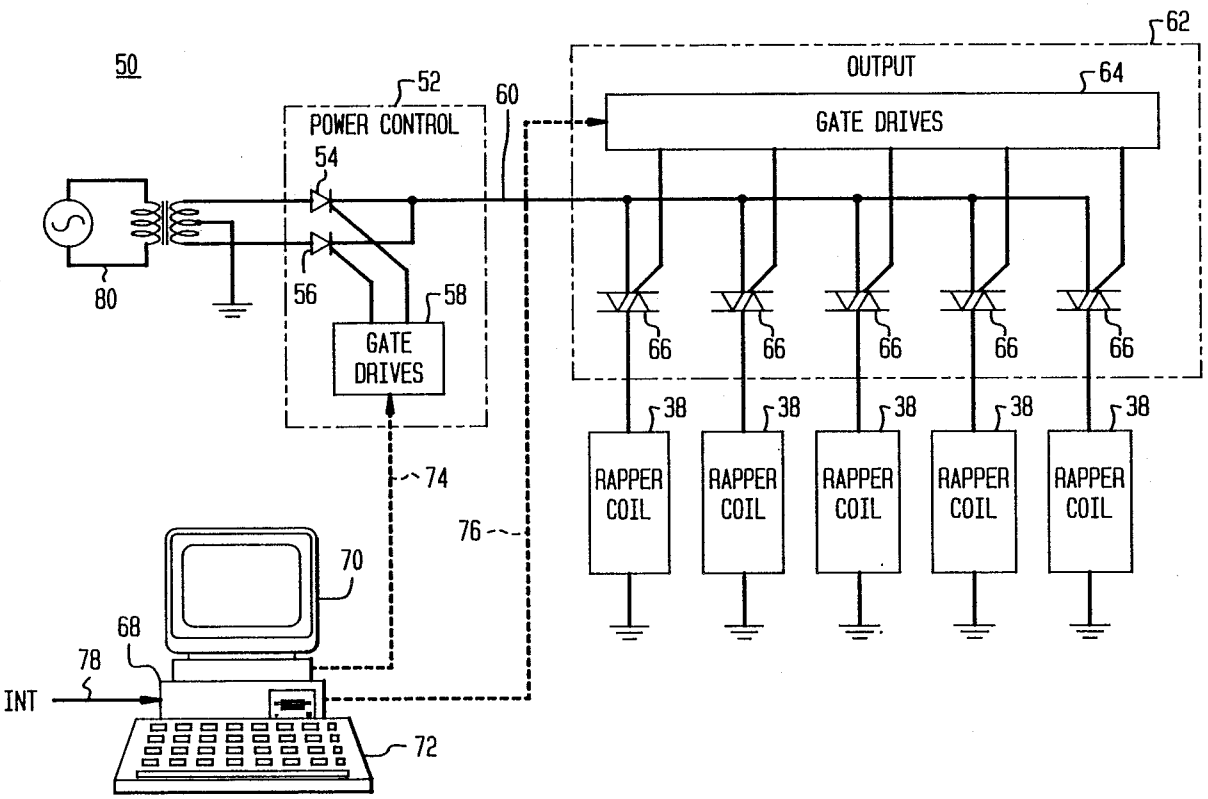
FIG. 4 shows control circuits for controlling the operation of the rapper of the system of FIG. 1.

Referring now to FIG. 4, there is shown control system 50 of system 10 for controlling a plurality of rappers 12 (not shown) having coils 38*a–e* requiring direct current excitation. The electrical excitation energy applied to selected coil 38*a–e* is controlled by silicon controlled rectifiers 54,56 and TRIACS 66*a–e* of control system 50. By controlling the energy applied to a coil 38*a–e*, the operation of a respective rapper 12 is controlled. Rappers 12 requiring alternating current excitation are controlled in a similar manner, except that silicon controlled rectifiers 54,56 are configured in an anti-parallel network (not shown) rather than a parallel network.

In the ramped intensity pulsing method of controlling rapper 12 within electrostatic precipitator system 10, a plurality of applications of mechanical energy is provided and the level of mechanical energy increases from one application to the next as previously described. This method may be enabled and disabled by an operator of system 10 using keypad 72 of computer 68. The listing for the program for computer 68 (which may be a Texas Instruments 99000) appears in the Microfiche Appendix and is written in 99000 Family Macro Assembler. When the operator enters the intensity or lift as well as the timing parameters for controlling rapper 12 using keypad 72, the operator is queried by way of display 70 whether the ramped intensity pulsing method should be enabled. Only if it is enabled can the operator select the number of raps as previously described. The operator may then select two, three or more raps.

Computer 68 then uses the selected rapper intensity or lift as the final or last rap intensity. The raps leading up to the final rap are assigned intensities which are scaled as a function of the selected number of raps. For example, if three raps are selected and the intensity is set at seventy-five, than the first rap is at 25% intensity, the second rap is at 50% intensity and the third rap is at 75% intensity.

Computer 68 then permits the operator to select the free fall aiding mechanism. If the free fall aiding mechanism is not selected the time interval between raps coincides with the cycle time of rapper 12. This typically results in a rap once every few minutes. If the ramped intensity pulsing is also selected the ramped intensity is applied to the rapper each time it is fired. Thus the first time the rapper is fired it is excited with the lowest energy level and the energy levels are increased until the maximum programmed intensity is applied. This process is then repeated every few minutes starting again with the lowest energy level. This process is described in the software appendix.

If the free fall aiding mechanism is selected computer 68 calculates the time interval between raps such that rapping coincides with the falling precipitate. The time between raps is calculated using the length of collecting surface 22 and the number of raps as previously described. The length data of collecting surface 22 is stored in the memory of computer 68. The duration of the time cycle of a gravity rapper 12 may be empirically approximated as rap time = lift X .5+.150. While operation of system 10 is illustrated with rapper excitation pulses 4,26,28 of three differing intensities, it will thus be understood that more intensities or fewer intensities may be provided.

Both the amount of applied electrical excitation energy and the selection of a rapper 12 are controlled by computer 68 having a keypad 72 and a display 70. Computer 68 which may be a Texas Instruments 9995, transmits commands to power control module 52 by way of control lines 74 which control gate drivers 58 and thereby the power applied to output module 62 by way of line 60. Computer 68 also transmits commands to output module 62 by way of lines 76 which control gate drivers 64 to select a TRIAC 66*a–e* and thereby a rapper coil 38*a–e* of a rapper 12.

Computer 68 receives an interrupt by way of interrupt line 78 at each zero crossing of the sixty Hertz alternating current source applied to transformer 80. These interrupts, which occur at each half-cycle of the source signal, cause computer 68 to execute a routine for determining the required conduction angle for the next half cycle following the interrupt. The routine for determining conduction angle is set forth in the software appendix.

The determined conduction angle is understood to be the number of degrees of the source waveform during which power is applied to output module 62 by silicon controlled rectifiers 54,56 under the control of computer 68 and gate drivers 58. Computer 68 also counts the number of interrupts occurring during application of power to output module 62 in order to control the time duration of power waveforms such as power waveforms 30,32,34 and thereby control the level of rapper excitation energy pulses 24,26,28.

In addition, computer 68 also determines which of the plurality of rapper coils 38 to energize through a TRIAC 66*a–e* of output module 62. When a rapper coil 38 is selected the gate of a TRIAC 66*a–e* corresponding to the selected coil 38*a–e* is turned on by gate drive 64 under the control of lines 76. To minimize magnetizing of rapper rods 14 power is applied to coils 38*a–e* for the shortest possible time interval which may provide the desired lift of a rod 14. In the preferred embodiment, an excitation period is realized by applying a measured number of full conduction cycles followed by a single half-cycle of reduced conduction.

Figure 5:
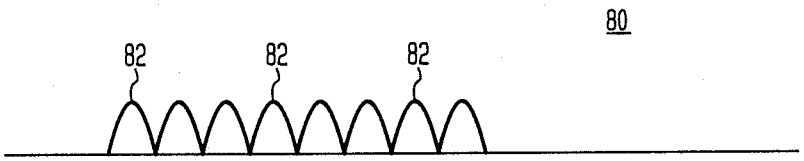
FIG. 5 shows a full half-cycle waveform for excitation of the rapper of FIG. 1.
Figure 6:
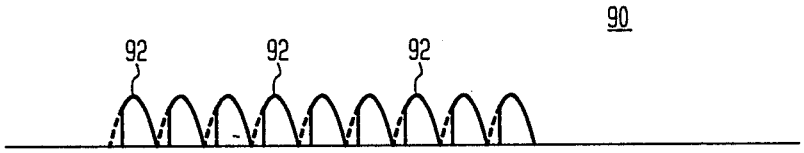
FIG. 6 shows a phase angle control waveform for controlling the rapper of FIG. 1.

It will be understood by those skilled in the art that at least two methods of regulating the lift of gravity return rappers 12 may be provided by computer 68 when an interrupt is applied to computer 68 by way of interrupt line 78: (1) full cycle control of excitation and (2) diminished conduction angle control of excitation. Referring now to FIGS. 5,6 there is shown excitation voltage half-cycle waveform 80 for full cycle excitation control and waveform 90 for phase angle or diminished conduction angle control. Both the full cycle method of waveform 80 and the diminished conduction angle control method of waveform 90 may be used in electrostatic precipitator system 10 of the present invention.

In the full cycle excitation of waveform 80 a series of a predetermined number of half-cycle pulses 82, each having a conduction angle of 180°, are applied to rapper coils 38*a–e* by way of TRIACS 66*a–e* under the control of computer 68. Each pulse 82 is applied in its entirety to a coil 38*a–e* and each pulse 82 of waveform 80 is thus a full conduction pulse. The total number of pulses 82 is determined by a user through the operator keypad 72 or similar input device when selecting lift. For most gravity return rappers 12, a number of pulses 82 from five to twelve is determined. The use of five pulses 82 provides a lift of approximately one inch to a rod weighing eight pounds. The use of twelve pulses results in maximum lift. The full cycle approach of waveform 80 applies power to rapper 12 for the minimum time duration for a selected lift and thereby minimizes magnetization.

However the full cycle does not allow precise control of the rapper lift because of the resolution possible when the full cycle is the smallest unit of power. Full cycle excitation power may be applied with approximately eight different energy levels corresponding to five, six, seven, eight, nine, ten, eleven, and twelve pulses 82. Eight different lift heights and corresponding energy levels are thus possible. Greater resolution of height control cannot be accomplished using the full cycle technique of waveform 80 because control is based on a minimum unit of one-half cycle of the source signal.

In the phase angle or diminished conduction angle control method of waveform 90 a series of a predetermined number of half-line cycle energizing pulses 92 with diminished conduction angle are applied to rapper coil 38. Pulses 92 thus have a conduction angle less than 180°. Through keypad 72, a specific lift is selected by a user and computer 68 determines a conduction angle, a duration of excitation, and a number of pulses 92. In the phase angle control method of waveform 90, all excitation pulses 92 are less than a full half-cycle. Thus resolution is increased because more different energy levels are provided between minimum and maximum. However, a longer period of excitation is required to obtain a selected lift. Because the duration of excitation is longer for the selected lift, the magnetization of rod 14 is greater.

Figure 7:
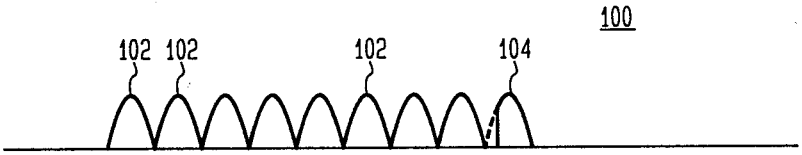
FIG. 7 shows full half-cycle pulses followed by a single phase angle control pulse for application to the rapper of FIG. 1.

Referring now to FIG. 7, there is shown waveform 100 for application to rapper coils 38*a–e* of rappers 12. Waveform 100 includes a series of energizing full-cycle pulses 102, each having a conduction angle of 180°, followed by single diminished conduction angle or phase controlled energizing pulse 104 having a conduction angle less than 180°. Phase controlled pulse 104 thus has a diminished conduction angle similar to that of pulses 92 of waveform 90.

Waveform 100 may advantageously be provided by computer 68 of system 10 to control the lift of rappers 12. Waveform 100 permits control of the energy to rapper 12 providing both half-cycle excitation and fractions of full half-cycle excitation thus decreasing the duration of rapper 12 energization to minimize magnetization of rod 14. Thus computer 68 may determine the number of full-cycle pulses 102 required to fall just a little short of the selected lift and make up the difference with a single phase controlled pulse 104 required to provide the selected lift.

If the same polarity of waveform 80, 90, 100 is always applied to rappers 12, rod 14 and casing 42 develop a residual magnetization which may cause rod 14 to stick to anvil 36 during applications of low-levels of mechanical energy to collecting surface 22. Thus, computer 68 may be programmed to apply the two different polarities of waveforms 80, 90, 100 alternately to prevent this magnetization. For example, if the rectified pulses of waveform 100 are applied with one polarity during one cleaning of collecting surface 22 and with the opposite polarity during the next cleaning of collecting surface 22, there is no net magnetization of rod 14 and casing 48 of rapper 12 because the second set of pulses substantially conceals the magnetization of the first.

Figure 8:
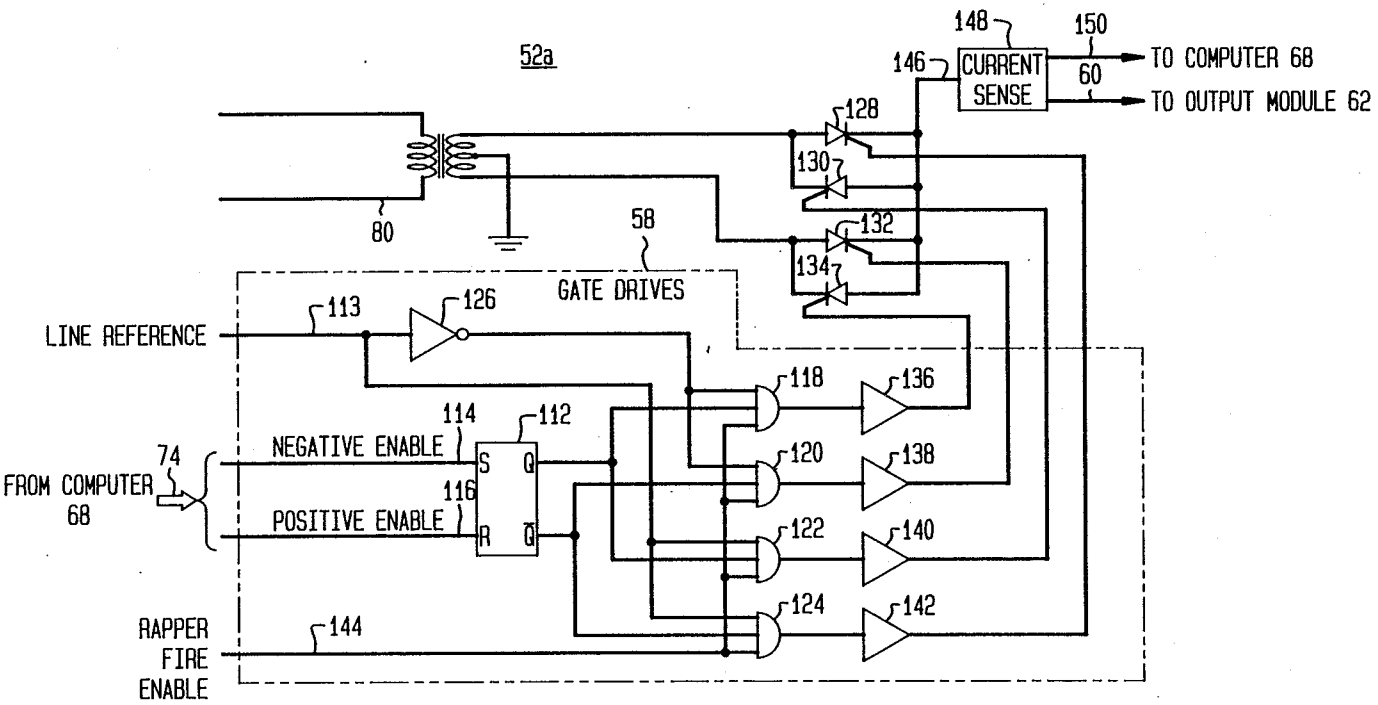
FIG. 8 shows an alternate embodiment of the power control module of FIG. 4.

Referring now to FIG. 8 there is shown power control module 52*a*, an alternate embodiment of power control module 52 of FIG. 4 for control of power applied to rapper coils 38*a–e* of rappers 12. Modules 52, 52*a* may each be advantageously used in system 10 and differ, for example, in the number of silicon controlled rectifiers and the addition of current sense 148. Either module 52 or module 52*a* may provide waveforms 80,90,100. Modules 52,52*a* may also control both the conduction angle of the applied power and the polarity of applied power.

Flip-flop 112 within gate drives 58 of control system 52*a* is set or reset through the negative enable signal of line 114 and the positive enable signal of line 116. These negative and positive enable signals of lines 114,116 are provided by computer 68 by way of lines 74 and are issued immediately following zero crossing of the line frequency If flip-flop 112 is set the Q output of flip-flop 112 goes high and provides an enable signal to AND gates 118, 122. AND gate 118 is further enabled by the output of inverter 126 during the half-cycle that line reference 113 is low thus providing gate drive to silicon controlled rectifier 134 through gate driver 136 when the rapper fire enable signal of line 144 is high. AND gate 122 is further enabled by the signal of line reference 113 during the half cycle that the line reference 113 is high, thus providing gate drive to silicon controlled rectifier 130 through gate driver 140 when the rapper fire enable signal of line 144 is high. In this way, negative voltage is applied to rapper coil 38 during each half-cycle.

If flip-flop 112 is reset, then the Q not output of flip flop 112 takes the true state and enables silicon controlled recitifiers 128,132 through AND gates 120,124 and gate drivers 138,142 respectively. Thus computer 68, by way of lines 74, may select either line 114 or line 116 of flip-flop 112 to reverse the polarity of the waveforms applied to rappers 12 to prevent residual magnetization of rappers 12. The magnetization caused by the rectified pulses of one polarity is thus substantially canceled by the rectified pulses of the opposite polarity.

Figure 9:
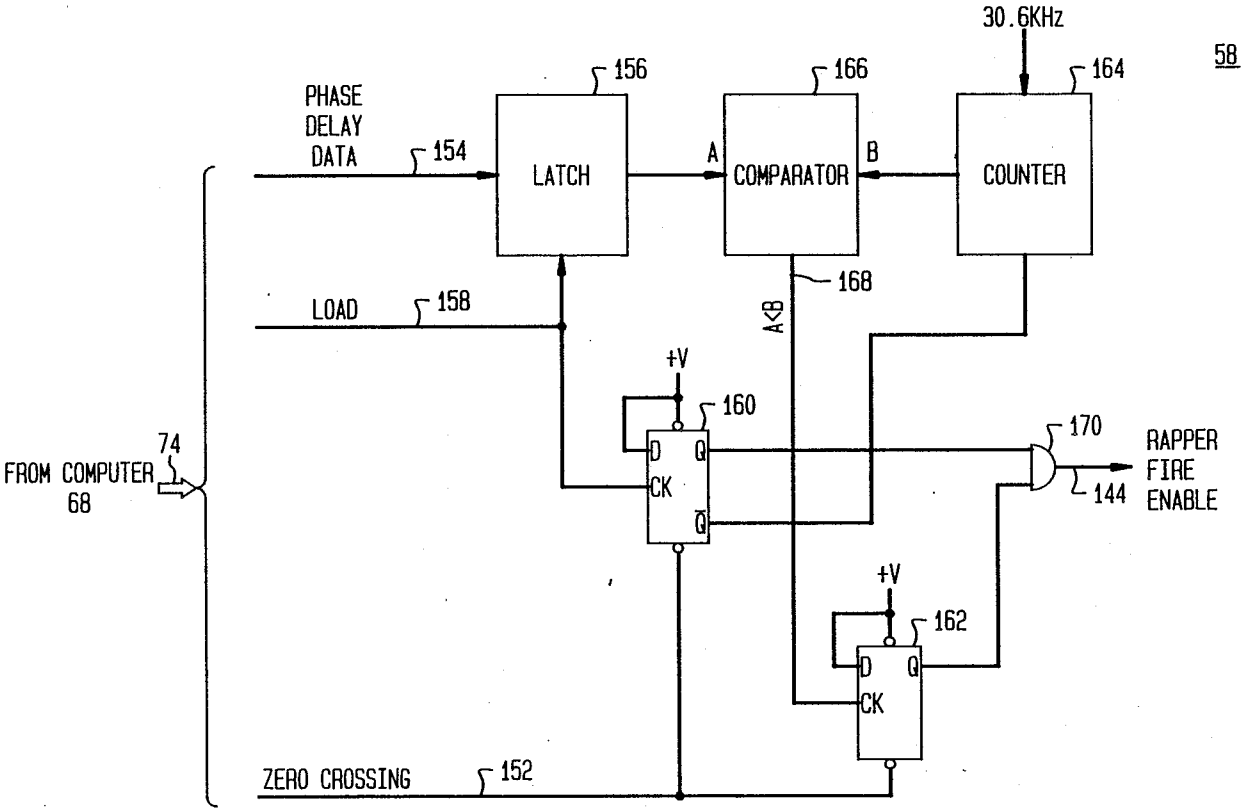
FIG. 9 shows a portion of the gate drives of FIG. 4 for digital control of phase.

Referring now to FIG. 9, there is shown a further portion of gate drives 58 for controlling the phase angle of pulses of waveforms 80,90,100 by controlling the operation of silicon controlled rectifiers within module 52 or module 52*a*. This portion of gate drives 58 provides the rapper fire enable signal of line 144 and thus provides digital phase control. The zero crossing signal of line 152 is generated at a one hundred twenty Hertz rate and is a series of negative going pulses sychronized to the source line frequency (not shown). Phase delay data 154 is an eight bit signal provided by computer 68 by way of lines 74 in accordance with the required amount of delay which is determined by computer 68 at each zero crossing. Phase control data 154 is loaded into latch 156 under the control of load signal 158.

The zero crossing signal of line 152 in addition to interrupting computer 68 to determine the phase angle of each half cycle, clears flip flop 160 and flip flop 162 to inhibit the rapper fire enable signal of line 144. When phase delay data 154 is presented with the required load pulse of line 158 the delay data is latched into latch 156 at the same time, flip flop 160 is set. Flip flop 160, when set, releases counter 164 to start its count. Counter 164 counts at a rate five hundred twelve times the line frequency such that a full eight bit count can occur each half line cycle.

When the contents of counter 164 equals the contents of latch 156 the output of comparator 166 on line 168 takes on "true" state and sets flip flop 162. When flip flop 162 is set at the same time flip flop 160 is set, then the AND function of gate 170 is satisfied and the rapper fire enable signal of line 144 takes the "true" state. The quantity loaded into latch 156 may thus be used to provide a controlled delay in the firing of silicon controlled rectifiers 128, 130, 132, 134 or rectifiers 54, 56 to provide diminished conduction angle pulses such as pulses 92, 104.

Input latch 156 must be reloaded each half-cycle. The quantity loaded may vary from zero to two hundred fifty-five. The quantity loaded causes delay in the output of rapper fire enable line 144 to vary directly with the loaded quantity. A zero loaded into latch 156 allows full conduction and two hundred fifty-five loaded into latch 156 allows no conduction.

Figure 10:
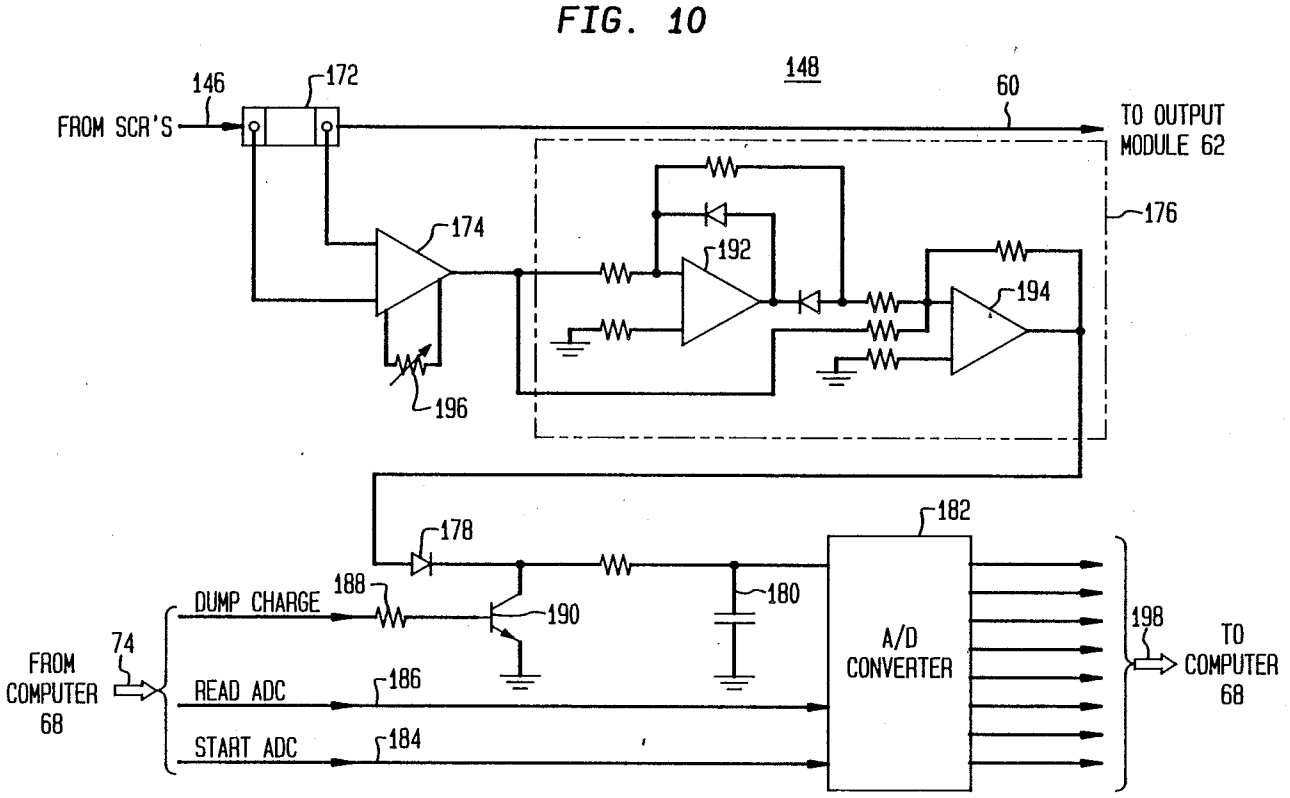
FIG. 10 shows the current sensing circuit of FIG. 8.

Referring now to FIG. 10 there is shown current sense module 148 of power control module 52*a* of FIG. 8. Current sense module 148 may also be used with power control module 52 of FIG. 4 and allows computer 68 to sense the current applied to coil 38 of rapper 12 and adjust the energy applied to coil 38 in accordance with the sensed current to control the time duration of power waveforms 32,30,34 and thereby control the level of energy of waveforms 24,26,28. The amount of current applied to coil 38 is affected by incoming line voltage, the total impedance of rapper coil 38 and its associated feed wires as well as temperature, total load and many other factors. As the above conditions change, computer 68 may compensate by varying the total excitation time of rapper 12 in accordance with the rapper coil current sensed by current sense module 148.

Current to rapper coil 38 passes through current shunt 172 to provide a voltage proportional to the current applied to coil 38. This voltage is applied to amplifier 174 having potentiometer 196 for gain control. Amplifier 174 provides isolation to protect computer 68 from the noise of line 146. The output of amplifier 174 is applied to rectifier 176. Rectifier 176, having amplifiers 192,914, provides an output which is always positive. Potentiometer 196 provides a means of calibration in addition to permitting current sensing circuit 148 to sense the current of rappers 12 when rappers 12 have different characteristics.

The voltage output of recitifier 176 charges capacitor 180 through diode 178 to the peak value of the output of rectifier 176. Computer 68 starts A/D converter 182 by way of start line 184 in a process set forth in the software appendix. This permits A/D converter 182 to acquire the voltage level of capacitor 180. Approximately, forty microseconds later computer 68, using read line 186 reads A/D converter 182. When the analog to digital conversion is complete and a new reading is to be made, computer 68 discharges capacitor 180 through transistor 190 by way of dump line 188. The value on data lines 198 is loaded into computer 68 when the read signal is provided to provide computer 68 with a value corresponding to a peak rapper current for the most recent half cycle.

Figure 11:
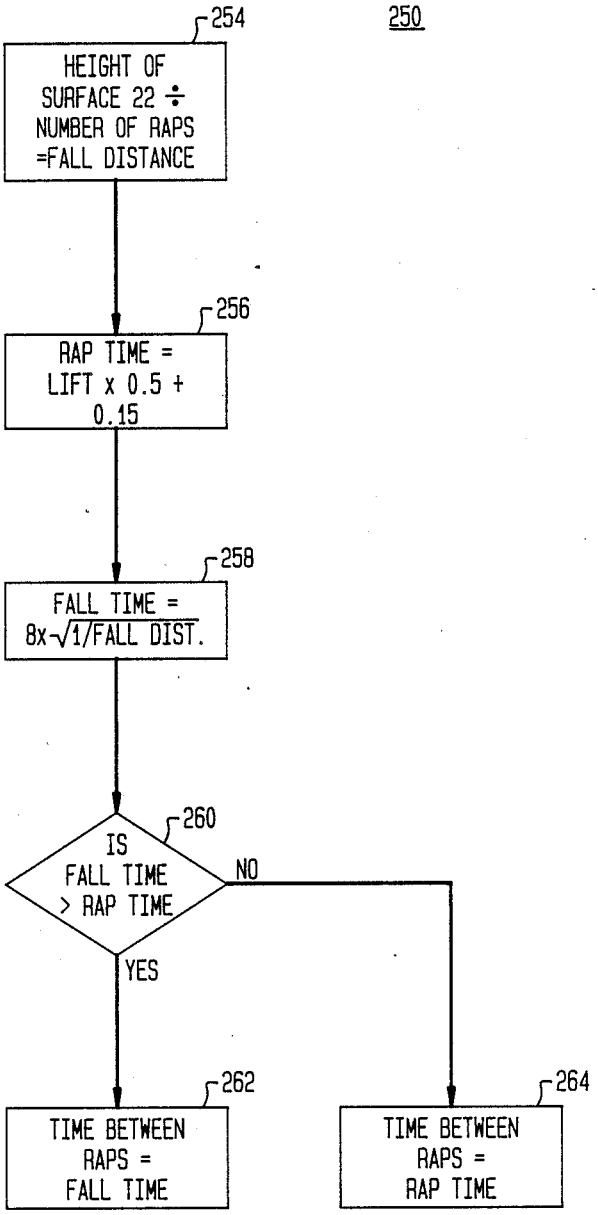
FIG. 11 shows a flow chart representation of a method for determining the waveforms of FIGS. 1, 2.

Referring now to FIG. 11 there is shown routine 250 for determining $t_1$ and $t_2$, the time between raps to achieve the free-fall aiding mechanism wherein the vibrations of a region of collecting surface 22 occur substantially simultaneously with the arrival of precipitate from higher regions. The height of collecting surface 22 is first divided by the number of raps selected by the user using keypad 72, as shown in block 254 to determine the fall distance between raps. As shown in block 256 the lift of rod 14 selected by the user using keypad 72 is multiplied by one-half and the result is added to .15 in order to determine the rap time.

As shown in block 258 the fall time of the precipitate is determined by multiplying the square root of reciprocal of the fall distance determined in block 254 by eight. In decision 260 a determination is made whether the fall time is greater than the rap time. If the fall time is greater than the rap time as determined in decision 260 the time between raps set equal to the fall time as shown in block 262. If the fall time is not greater than the rap time, as determined in decision 260, the time between raps is set equal to the rap time determined in block 256.

Figure 12:
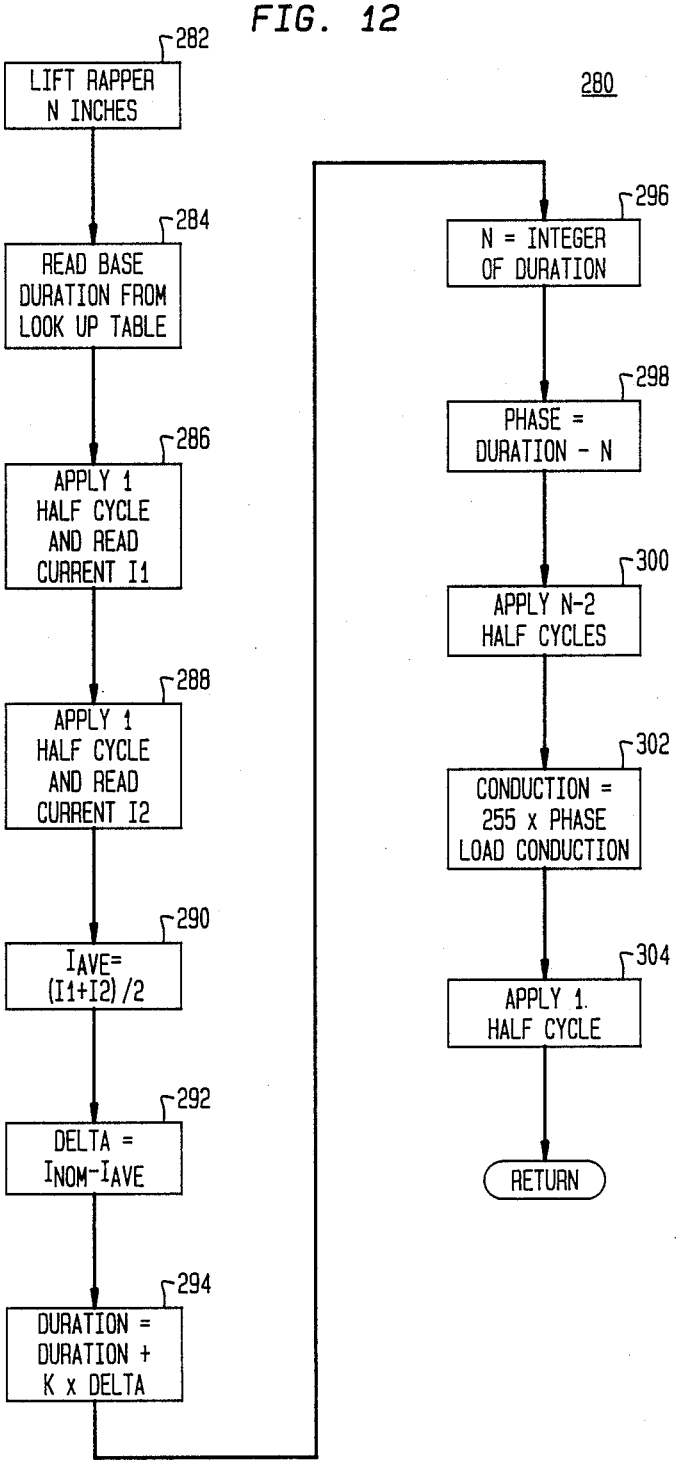
FIG. 12 shows a flow chart representation of a method for determining the waveforms of FIG. 7.

Referring now to FIG. 12, routine 280, set forth in the software appendix, is shown. Routine 280 determines the operation of current sense module 148 of power control module 52*a*. Computer 68 receives eight bits of information, by way of lines 198, to determine the peak level of current applied to coil 38 of rapper 12. In accordance with this feedback, computer 68 compensates for variations in line resistance, line length, and coil temperature. Computer 68 first reads the lift in inches selected by the user, as shown in block 282. This information is previously input into computer 68 by way of keypad 72.

The base duration is determined for the lift of block 282 from a look-up table as shown in block 284. The duration is usually determined empirically because there is a somewhat non-linear relationship between left and duration. The duration is thus associated with the required rapper left. Two half cycles are then applied to coil 38 as shown in blocks 286, 288. The peak values for each half cycle are read from current sense module 148 by computer 68 by way of lines 198. In blocks 290, 292 the average of the two peaks is determined and the difference between the determined value and nominal value is calculated. The compensated duration is determined in block 294.

The constant factor K which defines the relationship between the difference factor of block 292 and the compensated duration is also determined empirically. In block 296 computer 68 determines the integer portion of the duration wherein the integer portion is understood to be the number of full half-cycles which computer 68 may count within the duration period of time. The phase or diminished conduction angle pulse is then calculated in block 298. The waveform calculated in block 298 is pulse 104. Thus the duration has an integer portion and a fractional portion. Half cycles are applied a shown in block 300 wherein the half cycles are those described for pulses 102 and calculated in block 296. Thus, the number of full half cycles and the diminished half cycle are adjusted in accordance with the sensed current of current sense module 148.

The conduction of pulse 104 is then determined a shown in block 302 and one half cycle at this determined conduction is applied as shown in block 304. Thus routine 280 may apply waveform 100 as well as compensate for coil 38 current. The phase delay data determined in block 302 is loaded into latch 156 by way of computer 68 by way of lines 154 of lines 74.

We claim:

1. A method for removing precipitate from a collecting surface of an electrostatic precipitator having at least one rapper for applying a level of mechanical energy of variable time duration to an application point on a collecting surface in accordance with a level of electrical excitation applied to the rapper, comprising the steps of:

(a) applying mechanical energy to the application point through a single rap of a rapper, said single rap being of predetermined intensity, and (b) further applying mechanical energy of variable time duration to the application point through discrete raps of a rapper wherein the time duration is controlled by applying a predetermined number of full half cycle pulses followed by a single cycle of reduced conduction of electrical power and wherein the intensity of the applied mechanical energy is increased from one application of energy to another to prevent dispersion of precipitate removed from regions of the collecting surface relatively near the application point while removing precipitate from regions relatively distant from the application point.

2. A method for controlling the lift of a gravity return rapper having a rapper coil in a system for removing precipitate from a collecting surface of an electrostatic precipitator having an alternating energy source for energizing the rapper coil, comprising the steps of:

(a) determining a number of full half cycles of energy to be provided by the source in accordance with a predetermined rapper lift;

(b) determining a diminished conduction angle for a single half cycle of energy provided by the source wherein the total energy of the determined number of full half cycles and the single diminished conduction angle half-cycle is selected to provide the predetermined rapper lift; and (c) applying the determined number of half-cycles and the single diminished conduction angle half cycle to the rapper coil causing the rapper to lift and, by gravity return, strike the collecting surface.

3. The method of claim 2 wherein a plurality of rapper lifts are provided comprising the step of selecting a higher level of total energy from one rapper lift to another.

4. Method of claim 2 including the step of determining a duration associated with the predetermined rapper lift wherein the duration has an integer portion and a fractional portion.

5. The method of claim 4 wherein step (a) comprises determining the integer portion of the duration.

6. The method of claim 4 wherein step (b) comprises determining the fractional portion of the duration.

7. The method of claim 2 further comprising the steps of:

sensing the magnitude of the current applied to the rapper coil;

adjusting the determined number of full half cycles and the determined diminished conduction angle in accordance with the sensed magnitude to provide the predetermined rapper lift.

8. The method of claim 7 wherein the sensing step comprises sensing the magnitude of the first two of the full half-cycle pulses.

* * * * *